US008216322B2

(12) United States Patent
Schweickhardt

(10) Patent No.: US 8,216,322 B2
(45) Date of Patent: Jul. 10, 2012

(54) SOLID FUEL FIRE STARTER

(76) Inventor: Karl B. Schweickhardt, St. Louis County, MO (US)

( * ) Notice: Subject to any disclaimer, the term of this patent is extended or adjusted under 35 U.S.C. 154(b) by 2458 days.

(21) Appl. No.: 11/007,024

(22) Filed: Dec. 8, 2004

(65) Prior Publication Data

US 2006/0117649 A1 Jun. 8, 2006

(51) Int. Cl.
*C10L 5/36* (2006.01)
*C10L 11/00* (2006.01)

(52) U.S. Cl. ..... 44/535; 44/530; 44/532; 44/533; 44/544

(58) Field of Classification Search ..... 44/530, 44/532, 533, 544
See application file for complete search history.

(56) References Cited

U.S. PATENT DOCUMENTS

| | | | | |
|---|---|---|---|---|
| 2,622,017 | A * | 12/1952 | Bramhall et. al. | 44/519 |
| 3,759,675 | A * | 9/1973 | Lazarus | 431/6 |
| 4,417,900 | A | 11/1983 | Barthel | |
| 5,711,766 | A | 1/1998 | Bain | |
| 5,860,245 | A * | 1/1999 | Welch | 47/56 |
| 5,990,057 | A | 11/1999 | Sharp | |
| 6,093,224 | A | 7/2000 | Jones | |
| 6,306,353 | B2 * | 10/2001 | Freeman et al. | 422/126 |
| 6,379,405 | B1 | 4/2002 | Reiger et al. | |
| 6,508,849 | B1 | 1/2003 | Comas | |

* cited by examiner

*Primary Examiner* — Cephia D Toomer
*Assistant Examiner* — Vishal Vasisth
(74) *Attorney, Agent, or Firm* — Polster Lieder Woodruff & Lucchesi, L.C.

(57) ABSTRACT

The present invention is a solid fuel fire starter having a wicking element made of corrugated cardboard with an exposed top end for ignition by a flame source, a non-combustible housing surrounding the wicking element, the housing defining an open end for exposing the top end of the wicking element; and a paraffin wax reservoir within the housing integrally molded with the wicking element so that the wicking element conveys the paraffin wax by capillary action up into a flame.

16 Claims, 2 Drawing Sheets

SOLID FUEL FIRE STARTER

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION

Traditional methods of starting fires are time-consuming and unreliable. Typically, one starts a fire by placing dry kindling wood and paper below a stack of logs or charcoal. The paper is ignited and, if all goes well, the stack of logs eventually ignites. However, the success of traditional methods depends on a number of factors, including weather conditions, the amount and condition of combustible materials used, and the experience of the user. Consequently, alternative methods of starting fires have been proposed which are relatively unaffected by weather conditions, do not require the use of paper or kindling wood, and require little or no skill to use.

Generally, alternative methods involve the use of either liquid fuel or solid fuel fire starters. Liquid fuel fire starters have the disadvantage of being highly flammable and are subject to flashbacks, making them more dangerous to store and use than solid fuels. When liquid fuels are used to start charcoal fires for grilling food, liquid fuel often transfers a "chemical" flavor or smell to the food. Solid fuel fire starters are commonly rectangular-shaped blocks made of paraffin wax and cellulose material, such as sawdust or woodchips. The blocks are placed on a support located below a quantity of charcoal or wood, and ignited using a flame or other flame source. Sometimes the blocks are chemically treated to enhance the combustibility or burning temperature of the block.

Therefore, an economical solid fuel fire starter that eliminates the use of paper and kindling wood to start a fire is needed which requires little material, and is easy to handle, store, ship, use, cleanup and will not spill.

SUMMARY OF THE INVENTION

Briefly stated, the invention is a solid fuel fire starter having a wicking element with an exposed top end for ignition by a flame source, a non-combustible housing surrounding the wicking element, the housing defining an open end for exposing the top end of the wicking element, and a paraffin wax reservoir within the non-combustible housing with the paraffin wax integrally molded with the wicking element so that the wicking element conveys melted paraffin wax by capillary action up into a flame.

The foregoing and other features, and advantages of the invention as well as embodiments thereof will become more apparent from the reading of the following description in connection with the accompanying drawings.

DESCRIPTION OF THE DRAWINGS

In the accompanying drawings which form part of the specification.

Corresponding reference numerals indicate corresponding parts throughout the several figures of the drawings.

DETAILED DESCRIPTION

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
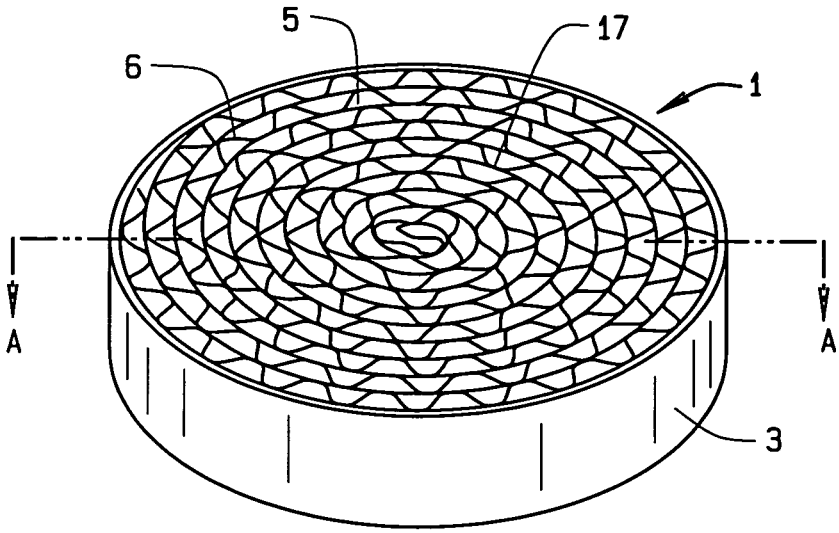
FIG. 1 is a perspective view of a preferred embodiment of the present invention.
Figure 2:
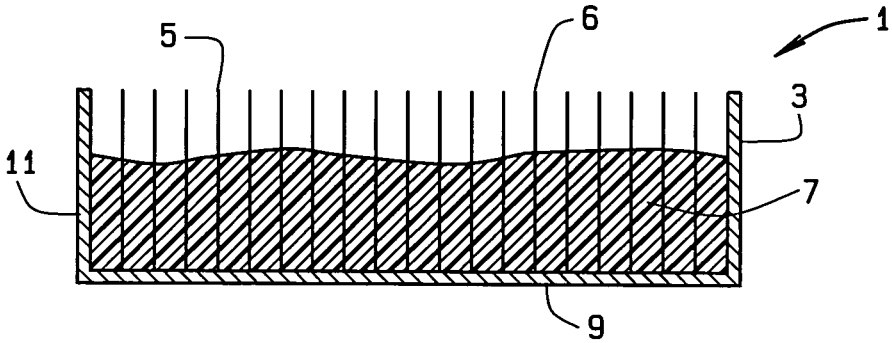
FIG. 2 is a sectional view of the preferred embodiment in FIG. 1 along A-A.
Figure 3:
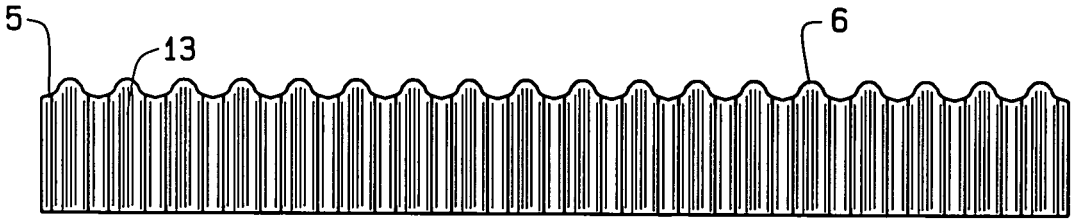
FIG. 3 is a plan view of a wicking element unrolled.
Figure 4:
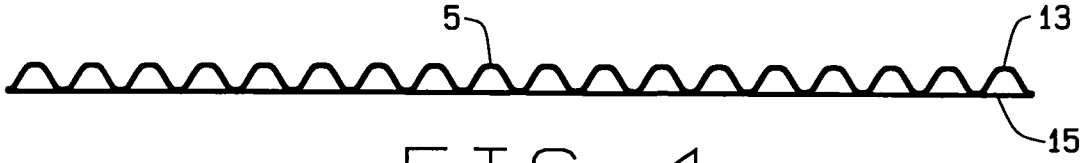
FIG. 4 is a top view of the wicking element unrolled.

As shown in FIGS. 1 and 2, an embodiment of the present invention, generally referred to as a solid fuel fire starter 1, includes a housing or pan 3 for holding a capillary wicking element 5. The pan 3 has a reservoir 7, preferably, but not necessarily, a paraffin wax fuel F, which is a solid up to at least 125° F.

The housing 3 is hollow with an open end and includes a base 9 and a sidewall 11 which extends upwardly from the base 9 and surrounds both the wicking element 5 and wax reservoir 7. The housing 3 is preferably, but not necessarily, made from a non-combustible material that will retain its shape at high temperature so that the housing 3 can contain the wicking element 5 and fuel F when ignited. In the present embodiment, the housing 3 is made from aluminum foil, or other suitable thin sheet metal that is pliable enough that it can be formed into a pan-shaped housing 3 and will retain its shape so as to support the wicking element 5 and wax reservoir 7 during combustion of the fire starter 1. In addition to sheet metal, other materials both rigid and pliable may be used, such as metals or glass may be used to fabricate housing 3.

In FIGS. 1 and 2, the wicking element 5 is shown to be formed of a coil of corrugated cardboard (paperboard). The wicking element 5 is dentated along the top edge, thereby defining a plurality of wicks 6. Preferably, the corrugated cardboard is a single faced corrugated cardboard, which includes one fluted layer 13 glued to one linerboard 15. The paperboard wicking element 5 is of a fibrous paper material having a large number of small capillaries between the fibers and/or within the fibers. When the fire starter 1 is ignited at the top end 17, the heat from the flame at least in part, melts a portion of the paraffin wax fuel F, and the wicking element 5 draws liquefied fuel upwardly by capillary attraction from the wax reservoir 7 to the wicks 6. The use of corrugated cardboard as the wicking element 5 also makes the fire starter 1 lightweight and environmentally friendly because it is largely made from recycled materials. In addition, the wicking element will be consumed by the flame.

While the wicking element 5 in FIGS. 1-5 is preferably single faced corrugated cardboard, other suitable wicking materials, such as cloth, non-woven fibrous material, or roping, may be used. In addition, numerous combinations of corrugated board types, geometries, flute sizes, weights, and strengths may be used. Some variations of cardboard types include double faced corrugated cardboard, double walled corrugated cardboard, "B" flute, "C" flute, "E" flute, and honeycomb shaped paperboard material. In addition, those skilled in the art will recognize that the wicks 6 along the top edge of the wicking element can be defined by other shapes, such as crenate.

To assemble the fire starter 1, a strip of corrugated cardboard preferably having a width substantially equal to the height of the housing 3 is rolled up into a coil with the flutes orientated vertically to form the wicking element 5. The coiled wicking element 5 is installed in housing 3, such that the upper edges of element 5 are approximately level with the upper edge of housing 3. Preferably, a food grade paraffin wax, such as No. BW 407 or BW 422 paraffin food grade was, commercially available from Blended Wax, Inc. of Oshkosh, Wis. may be used. These waxes have respective melting temperatures of about 128° F. and 143° F. The paraffin wax is heated until liquefied and, subsequently, poured into the flutes 13 of the wicking element 5 which is first installed in the housing 3. The flutes should not be completely filled to the top, but should be filled to a level, approximately ¼"-½" inch below the upper edge of the coiled element 5 so as to leave a top end 17 of the wicking element 5 exposed for ignition and for forming a wick. As the paraffin wax is poured into the housing, the wax will impregnate the upper ends of element 5, thus making it easy to light with a within the housing 3 that is integrally molded with the wicking element 5. The wax reservoir 7 also bonds the housing 3 to the wicking element 5.

Figure 5:
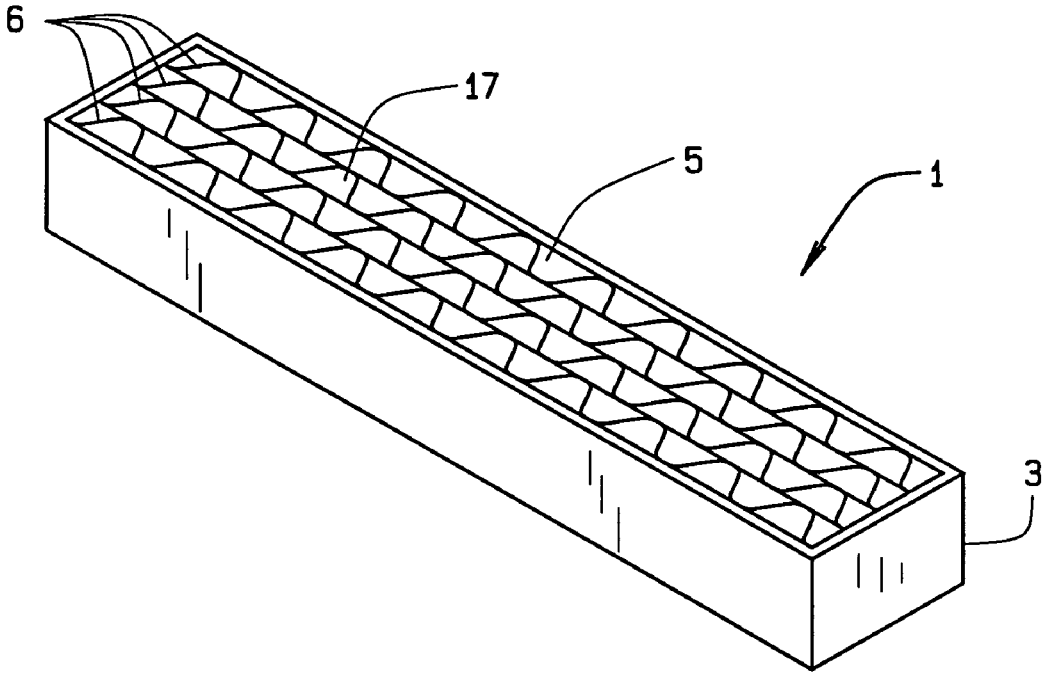
FIG. 5 is an alternate embodiment of the present invention.

As noted, the wax in reservoir 7 is preferably a food grade paraffin wax that does not emit toxic or noxious fumes when burned. Other fuels which are solids at normal ambient temperatures but which readily melt at temperatures above room temperature, such as candle wax, may also be used. Because the fuel is in solid form, the fire starter 1 can safely transported without spilling of the fuel. Because the solid fuel preferable is a food grade or other non-toxic fume emitting fuel, the fire starter 1 of this invention may be used to start fires for cooking food or for indoor fireplaces. Besides providing a solid fuel for the fire starter 1 and bonding the housing 3 with the wicking element 5, the wax reservoir also makes the fire starter 1 water resistant by acting as a moisture barrier over the wicking element 5. The size of the fire starter 1 can be varied to produce a flame that lasts any desired amount of time and that emits a flame of sufficient size (e.g., diameter) so as to readily ignite charcoal in a barbecue grill or to ignite kindling or fire wood in a campfire or the like. For example, a smaller rectangular, as shown in FIG. 5, size fire starter may be about ¾ inches×1½ inches. A larger, circular fire starter, as shown in FIG. 1, may have a diameter of about 3½ inches. However, those skilled in the art will recognize that the size and height of the fire starter of this invention may vary widely. In general, fire starter 1 should be of a sufficient size and contain a sufficient wax reservoir 7 to produce a flame for a time sufficient to ignite a desired quantity of material (e.g., wood or charcoal).

In operation, the fire starter 1 is placed directly beneath a quantity of material to be burned (not shown), such as charcoal or wood. No additional support structure is needed to support the fire starter 1. The exposed top end 17 of the wicking element 5 is ignited using a flame source. At first, the wicking element 5 doesn't itself burn, but draws the wax reservoir 7 up through the body of the fluted layer 13 and linerboard 15 to the wicks 6 by a capillary effect. Thus, the wax burns at the wicks 6 producing a flame that ignites the quantity of material to be burned. The housing contains a sufficient quantity of wax (or other suitable solid fuel) to burn a sufficient time (typically 5-20 minutes) so as to ignite the material to be burned. When the wax reservoir 7 is exhausted, the wicking element 5 itself ignites and burns until the wicking element 5 is completely consumed. Thus, the only remaining waste is the housing 3 and a small amount of ash from the consumed wicking element 5. When the housing 3 is made of aluminum foil or the like, the housing 3 will remain in tact so as to hold the wax in the reservoir, but as the wax is consumed, the heat of the flame will consume the wicking element 5 and at least to a limited degree may cause the housing 3 to partially disintegrate or decompose so as to take up less space within the area of the fire. In addition, the weight of the charcoal or firewood may cause the housing to be deformed so as to take up less space.

While, the embodiment in FIGS. 1 and 2 discloses a circular fire starter 1 using a dentated coil-shaped wicking element 5, any shape and size fire starter 1 and wicking element 5 can be used. For example, the present invention can be embodied in the form of FIG. 5. In this alternate embodiment, the wicking element 5 is made of strips of corrugated cardboard that are aligned in parallel with the flutes vertically orientated within a rectangular shaped housing 3. All other aspects of this embodiment are similar to the embodiment in FIGS. 1 and 2.

Figure 6:
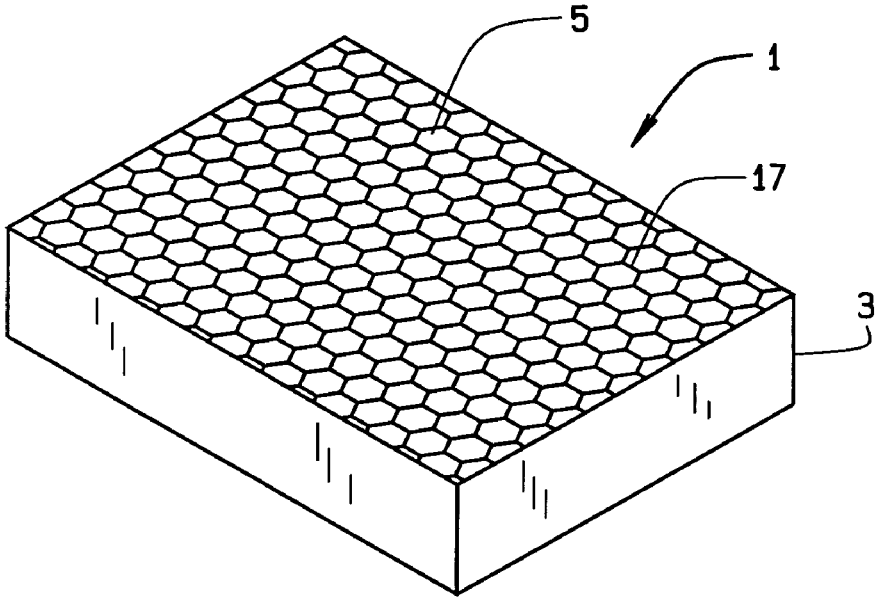
FIG. 6 is another alternate embodiment of the present invention.

The present invention can also be embodied in the form of FIG. 6. In this alternate embodiment, the wicking element 5 is made of a honeycomb shaped corrugated cardboard. Again, all other aspects of this embodiment are similar to the embodiment in FIGS. 1 and 2.

Those skilled in the art will also appreciate that additives can be used with the wax fuel F. For example, an airborne insect repellant, such as citronella oil, may be added to the wax such that as the wax burns, the citronella will repel insects in the vicinity of the fire and will yield a pleasant smell. Another example is fragrances like, vanilla, cinnamon, and pine.

Changes can be made in the above constructions without departing from the scope of the invention, it is intended that all matter contained in the above description or shown in the accompanying drawings shall be interpreted as illustrative and not in a limiting sense.

The invention claimed is:

1. A solid fuel fire starter comprising:

a wicking element with an exposed top end for ignition by a flame source;

a non-combustible housing surrounding the wicking element, the housing defining an open end for exposing the top end of the wicking element; and a solid fuel reservoir within the housing integrally molded with the wicking element so that the burning of the wicking element at least in part melts the solid fuel so that the wicking element conveys the solid fuel by capillary action up the wicking element to be burned in a flame; and wherein the wicking element comprises a strip of corrugated paperboard having flutes vertically orientated.

2. The solid fuel fire starter of claim 1 further comprising a plurality of wicks along the exposed top end of the wicking element.

3. The solid fuel fire starter of claim 1 wherein the housing is of a non-combustible material.

4. The solid fuel fire starter of claim 1 wherein the housing is of a sheet metal.

5. The solid fuel starter of claim 1 wherein the wicking element comprises honeycomb-shaped paperboard.

6. The solid fuel starter of claim 4 wherein the wicking element comprises a coil of corrugated paperboard having a plurality of flutes with the flutes vertically orientated.

7. The solid fuel starter of claim 4 wherein the wicking element comprises strips of corrugated paperboard aligned in parallel and flutes vertically orientated.

8. The solid fuel fire starter of claim 1 wherein the solid fuel is a paraffin wax poured into the housing in liquid form so as to at least in part surround the wicking element and to bond the wicking element in place within the housing.

9. The solid fuel starter of claim 8 wherein with the paraffin wax poured within the housing, the wicking element extends above the level of the wax so as to form an exposed wick, thereby to facilitate lighting of the starter.

10. A solid fuel fire starter comprising:

a wicking element with an exposed upper end for ignition by a flame source;

an open top, non-combustible housing receiving the wicking element;

a wax fuel reservoir cast in place within the housing, thereby molding the wicking element within the housing so that upon igniting of the upper end of the wicking element, the wicking element draws the liquid wax by capillary action up into a flame; and wherein the wicking element comprises corrugated paperboard having a plurality of flutes with the flutes vertically orientated.

11. The solid fuel fire starter of claim 10 further comprising a plurality of wicking elements along the upper end of the wicking element.

12. The solid fuel fire starter of claim 10 wherein the housing comprises sheet metal.

13. The solid fuel fire starter of claim 10 wherein the wicking element comprises honeycomb-shaped corrugated paperboard.

14. The solid fuel fire starter of claim 1 wherein the wicking element comprises a coil of corrugated paperboard having a plurality of flutes with the flutes vertically orientated.

15. The solid fuel fire starter of claim 1 wherein the wicking element comprises strips of corrugated cardboard aligned in parallel having a plurality of flutes with the flutes vertically orientated.

16. The solid fuel fire starter of claim 10 wherein the upper end of the wicking element extends above the level of the wax in the housing.

* * * * *